United States Patent [19]

Imai et al.

[11] Patent Number: 4,980,122

[45] Date of Patent: Dec. 25, 1990

[54] METHOD FOR PRODUCTION OF SUPERPLASTIC COMPOSITE MATERIAL HAVING ALUMINUM METAL SUBSTANCE REINFORCED WITH SILICON NITRIDE

[75] Inventors: Tsunemichi Imai; Mamoru Mabuchi, both of Nagoya, Japan

[73] Assignee: Agency of Industrial Science & Technology, Ministry of International Trade & Industry, Tokyo, Japan

[21] Appl. No.: 497,884

[22] Filed: Mar. 23, 1990

[30] Foreign Application Priority Data

Jun. 15, 1989 [JP] Japan ..... 1-152804

[51] Int. Cl.[5] ..... B22F 3/24

[52] U.S. Cl. ..... 419/13; 75/244; 419/23; 419/24; 419/28; 419/29; 419/53; 419/54; 419/55; 419/60

[58] Field of Search ..... 419/13, 23, 24, 28, 419/29, 53, 54, 55, 60; 75/244

[56] References Cited

U.S. PATENT DOCUMENTS

| | | | |
|---|---|---|---|
| 4,685,607 | 8/1987 | Takeda et al. | 419/13 |
| 4,735,656 | 4/1988 | Schaefer et al. | 419/13 |
| 4,889,686 | 12/1989 | Singh et al. | 419/13 |
| 4,894,088 | 1/1990 | Yamaguchi et al. | 419/13 |

OTHER PUBLICATIONS

Vol. 39, No. 11, "Superplasticity in Silicon Nitride Whisker Reinforced 2124 Aluminum Alloy Composite", (1989), pp. 831–833.

"Superplasticity in a High Strength Powder Aluminum Alloy With and Without SiC Reinforcement", vol. 18A, Apr. 1987, pp. 653–661.

Six International Conference on Composite Materials ICCM & ECCM, vol. 2, (1986), "Superplasticity in SiC Reinforced Al Alloys", pp. 2.373–2.381.

Composites Science and Technology (1989), 105–120, "Influence of Anisotropic Distribution of Whiskers on the Superplastic Behavior of Aluminum in a Back-Extruded 6061 Al-20% SiCw Composite".

Scripta Metallurgica, vol. 18, pp. 1405–1408, (1984), "Superplasticity at High Strain Rates in a SiC Whisker Reinforced Al Alloy".

*Primary Examiner*—Stephen J. Lechert, Jr.

*Attorney, Agent, or Firm*—Oblon, Spivak, McClelland, Maier & Neustadt

[57] ABSTRACT

A superplastic composite material is produced by thoroughly and homogeneously mixing particles or whiskers of silicon nitride and aluminum metal powder in a solvent, then removing the solvent from the resultant mixture, sintering the residual mixture at an elevated temperature, further compressing it at an elevated temperature, then hot extrusion-molding the compressed mixture thereby forming a shaped article, and heat-treating this shaped article.

6 Claims, 2 Drawing Sheets

METHOD FOR PRODUCTION OF SUPERPLASTIC COMPOSITE MATERIAL HAVING ALUMINUM METAL SUBSTANCE REINFORCED WITH SILICON NITRIDE

BACKGROUND OF THE INVENTION

1. Field of the Invention

This invention relates to a method for the production of a superplastic composite material comprising an aluminum metal substance such as 2124 aluminum alloy or 6061 aluminum alloy used as a matrix and silicon nitride whiskers or particles incorporated as a reinforcing agent in the matrix.

2. Prior Art Statement

The fiber-reinforced metal material (FRM), a composite material which comprises such a metallic matrix as aluminum or an aluminum alloy and whiskers or particles of SiC or $Si_3N_4$, is light, exhibits high rigidity and strength, and excels in resistance to heat and resistance to friction and, therefore, is suitable as a material for structural members of automobile engine parts and of aerospace equipment.

Such relatively simple parts as automobile engine parts (pistons and connecting rods, for example) can be directly molded in their finished shaped by the melt forging method or powder metallurgy method using the aforementioned FRM in the form of melt or powder. Such intricately-shaped parts as aircraft door panels, for example, are produced by preparatorily producing a composite material plate from the melt or powder of FRM and forming the composite material plate in a desired shape. Thus these intricately-shaped parts require secondary fabrication. Among the techniques available for the secondary fabrication, hot precision machining is most practical. A need has arisen for developing a composite plate, a composite material plate of superplasticity, suitable for the hot precision machine.

The whiskers or particles of SiC or $Si_3N_4$ (hereinafter referred to simply as "ceramic whiskers or particles") which are contained in the composite materials are extremely hard. The conventional composite materials using the ceramic whiskers or particles suffer from notable degradation of ductility (workability) when the content of such ceramic whiskers or particles reaches several percent. For example, a composite material containing ceramic whiskers or particles sustains defects due to the ceramic whiskers or particles when the composite material is machined.

For the superplastic composite material to retain its high rigidity and strength intact, it is necessary for the matrix and the ceramic whiskers or particles to be strongly joined at their boundary surface. For the composite material to manifest superplasticity, it is necessary for the matrix to be formed of very minute crystal grains.

SUMMARY OF THE INVENTION

The present inventors have continued a study in search of a superplastic composite material which fulfills the requirements described above. The present invention has been perfected as the result.

Specifically, this invention is directed to a method for the production of a superplastic composite material having an aluminum metal substance reinforced with silicon nitride, which method essentially consists of using a solvent to wet mixing either particles or whiskers of silicon nitride with metallic aluminum powder of a particle diameter of not more than 50 μm, removing the solvent from the resultant mixture, sintering the residual mixture by heating in a vacuum, heating the resultant sintered article under pressure, hot extrusion-molding the heated article thereby forming a shaped article, and heat-treating the shaped article.

The above and other features and objects of the invention will become apparent with the following detailed description made with reference to the attached drawings.

DETAILED DESCRIPTION OF THE PREFERRED EMBODIMENTS

The composite material produced by the method of the present invention has an aluminum metal substance as its matrix. Though the purity of aluminum in the aluminum metal substance is not particularly defined, it is required to be at least 80% and desired to exceed 85% from the practical point of view. If the purity is unduly low, the characteristic of aluminum required for the matrix is not manifested sufficiently.

The silicon nitride is incorporated in the composite material for the purpose of enhancing its strength. However, it must be allowed to adversely affect the superplasticity of the composite material.

The largest allowable content of silicon nitride in the composite material is 25% by volume. Preferably, the content is in the range of 15 to 20% by volume.

Figure 1:
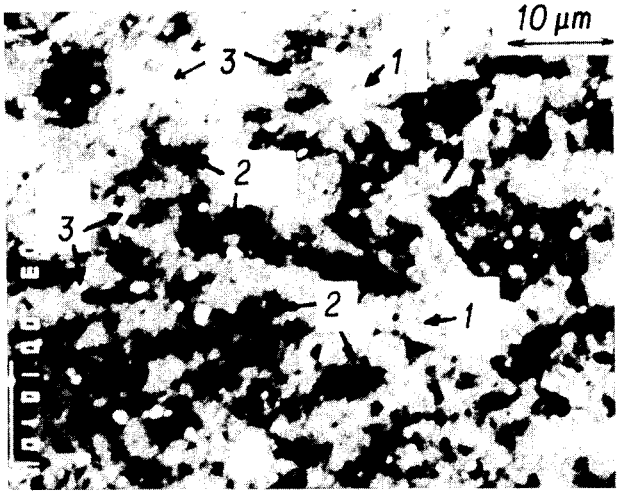
FIG. 1 is a photomicrograph of a superplastic composite material produced by the method of the present invention.

Then, in the present invention, the aluminum metal powder must be thoroughly mixed with the silicon nitride. For this purpose, the two substances must be mixed by the wet method. Thorough mixing is accomplished by placing the aluminum metal powder and silicon nitride in an organic solvent such as, for example, alcohol or acetone and exposing the resultant mixture as to ultrasonic waves. Then, a homogeneous mixture of the two substances is obtained by removing the organic solvent from the solution of the aluminum metal powder and silicon nitride in the organic solvent. This homogeneous mixture is sintered under pressure to form a sintered article and this sintered article is further heated under pressure. The conditions for the sintering under pressure are practically at least 200° C. and 50 MPa and preferably 400° C. to 650° C. and 300 to 500 MPa. The sintered article thus obtained is again treated practically at least 200° C. and 50 MPa or preferably 400° C. to 650° C. and 300 to 500 MPa, and subjected to hot extrusion-molding. As a result, the superplastic composite material aimed at by this invention can be obtained. FIG. 1 is an electron micrograph of a composite material obtained by the method of this invention. In the photograph, the gray parts indicated by the numeral 1 are an aluminum metal matrix and the black parts indicated by the numeral 2 are silicon nitride spots and the white parts indicated by the numeral 3 are precipitates which originate in a component contained in the aluminum alloy.

As shown in FIG. 1, the composite material obtained by the method of this invention has silicon nitride dispersed substantially uniformly in the matrix. The aluminum metal powder for use in the composite material consists of very minute particles. During the course of hot working, propagation of the dislocation by the ceramic whiskers accelerates recrystallization and, at the same time, the ceramic whiskers function to check the growth of minute crystal grains and permit fine division of crystal grains.

As demonstrated in the working examples cited below, the composite material produced by the method of this invention exhibits superplasticity.

As regards the conditions for the aforementioned hot extrusion-molding process, the extrusion ratio is at least 5 and the temperature is at least 300° C. and preferably the extruding ratio is in the range of 30 to 50 and the temperature is in the range of 400° C. to 600° C. If the conditions are short of the lower limits mentioned above, the composite material produced fails to acquire sufficient superplasticity.

Now, the present invention will be described more specifically below with reference to working examples.

EXAMPLE 1

Silicon nitride whiskers and 2124 (max 44 μm) aluminum alloy powder were measured out in volumes calculated to give a whisker content of 20% by volume and were uniformly mixed in alcohol under exposure to ultrasonic waves. The alcohol was removed from the resultant mixture by evaporation. The resultant uniform mixture of silicon nitride and aluminum alloy powder was sintered in a hot press under a vacuum, using a temperature of 600° C. and a pressure of 200 MPa. The sintered article consequently obtained was left standing at a temperature of 600° C. under a pressure of 400 MPa for 20 minutes, to be recompressed. The compressed sintered article was placed in an aluminum tube and subjected statically to hot-extrusion molding at an extrusion ratio of 44 at a temperature of 500° C., to form a rod material 6 mm in diameter. By subjecting this rod material to a T6 heat treatment (8 hours' standing at 500° C., cooling the rod material with water, not less than 16 hours' standing at 190° C., and cooling the resultant rod material with air), a superplastic composite material was obtained.

Owing to the effect of precipitation caused by the T6 heat treatment, the produced superplastic composite material acquired enhanced strength.

Then, this composite material was given a tensile test at 525° C. The results are shown in FIG. 2 and FIG. 3.

Figure 2:
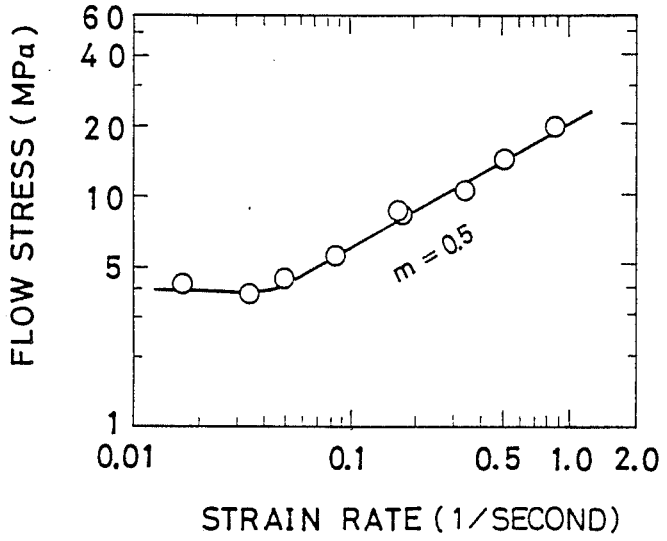
FIG. 2 is a graph showing the relation between the strain rate and the deformation resistance, based on the results of a tensile test performed on a composite material produced in a working example.

FIG. 2 is a graph showing the relation between the deformation resistance/MPa and the strain rate/second. The slope of the curve 4 indicates the strain rate sensitivity index m. In the diagram, m is 0.5. A sample having an index of not less than 0.3 exhibits superplasticity. The diagram indicates, therefore, that the composite material produced by the method of this invention possesses superplasticity.

Figure 3:
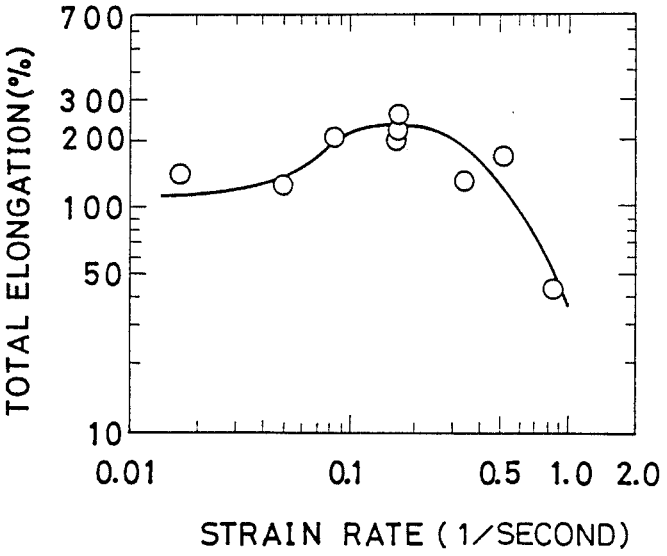
FIG. 3 is a graph showing the relation between the strain rate and the total elongation, based on the results of a tensile test performed on a composite material produced in another working example.

FIG. 3 is a graph showing the relation between the total elongation (in %) and the strain rate/second. The diagram indicates that the total elongation was in the range of 200 to 250% when the strain rate was 0.171/second. Since the magnitude of 250% is generally held to represent a satisfactory elongation for practical purposes, the large total elongation shown in the diagram was due to superplasticity.

EXAMPLE 2

In a solvent consisting of alcohol and water in a ratio of 1:1 by volume, silicon nitride whiskers and 6061 aluminum alloy powder (max 15 μm) were mixed by means of a mixer, to form a mixed powder having a whisker content of 20% by volume. This mixed powder was sintered at 600° C. under a load of 200 MPa. The resultant sintered article was left standing in the open air at 500° C. under a pressure of 400 MPa for 20 minutes. From this point onward, it was treated in the same manner as in Example 1, to obtain a composite material.

This composite material was given a tensile test. It showed an elongation exceeding 200% at a strain rate in the range of 0.1 to 2.0 l/second at a temperature in the range of 525° C. to 555° C. In this range, the magnitude of m reached the maximum of 0.5. Thus, this composite material manifested superplasticity.

What is claimed is:

1. A method for the production of a superplastic composite material having an aluminum metal substance reinforced with silicon nitride, which method essentially consists of using a solvent to wet mixing either particles or whiskers of silicon nitride with metallic aluminum powder of a particle diameter of not more than 50 μm, removing the solvent from the resultant mixture, sintering the residual mixture by heating in a vacuum, heating the resultant sintered article under pressure, hot extrusion-molding the heated article thereby forming a shaped article, and heat-treating the shaped article.

2. A method according to claim 1, wherein said silicon nitride powder possesses a maximum particle diameter of 50 μm.

3. A method according to claim 1, wherein the content of silicon nitride in the composite material is not more than 20% by volume, based on the total volume of silicon nitride and aluminum metal powder.

4. A method according to claim 1, wherein the purity of aluminum in said aluminum metal powder is at least 85% by weight.

5. A method according to claim 1, wherein said wet mixing comprises mixing silicon nitride and aluminum metal powder in an organic solvent and under the influence of ultrasonic waves.

6. A method according to claim 1, wherein the shaped article is subjected to T6 heat treatment.

* * * * *